US007971301B2

(12) United States Patent
Park et al.

(10) Patent No.: US 7,971,301 B2
(45) Date of Patent: Jul. 5, 2011

(54) WASHING MACHINE AND THE CONTROL METHOD OF THE SAME

(75) Inventors: Seok Kyu Park, Changwon-si (KR); Seog Ho Go, Chagwon-si (KR); Bo Sun Chung, Pusan (KR); Young Soo Kim, Changwon-si (KR); Young Man Yang, Changwon-si (KR); Gyoo Cheol Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1049 days.

(21) Appl. No.: 10/558,189

(22) PCT Filed: May 28, 2004

(86) PCT No.: PCT/KR2004/001255

§ 371 (c)(1),
(2), (4) Date: Aug. 4, 2006

(87) PCT Pub. No.: WO2004/106615

PCT Pub. Date: Dec. 9, 2004

(65) Prior Publication Data

US 2007/0028397 A1 Feb. 8, 2007

(30) Foreign Application Priority Data

| | | |
|---|---|---|
| May 28, 2003 | (KR) | 10-2003-0034003 |
| May 28, 2003 | (KR) | 10-2003-0034004 |
| Jun. 20, 2003 | (KR) | 10-2003-0040220 |
| Jun. 21, 2003 | (KR) | 10-2003-0040493 |
| Jun. 21, 2003 | (KR) | 10-2003-0040494 |
| Jun. 21, 2003 | (KR) | 10-2003-0040495 |

(51) Int. Cl.
*D06F 33/00* (2006.01)
*D06F 35/00* (2006.01)

(52) U.S. Cl. ..... 8/158

(58) Field of Classification Search ..... 8/158–159
See application file for complete search history.

(56) References Cited

U.S. PATENT DOCUMENTS

| | | | |
|---|---|---|---|
| 3,393,970 A | 7/1968 | Martz, Jr. | |
| 3,645,669 A | 2/1972 | Rausch | |
| 5,419,163 A | 5/1995 | Kim et al. | |
| 5,694,793 A | 12/1997 | Nishimura et al. | 68/12.27 |
| 6,536,060 B1 | 3/2003 | Janssens et al. | |
| 6,766,812 B1 | 7/2004 | Gadini | |

(Continued)

FOREIGN PATENT DOCUMENTS

CN 1548608 11/2004

(Continued)

OTHER PUBLICATIONS

Machine translation of JP 2001/17775 to Toshiba Corp., date not applicable.*

(Continued)

*Primary Examiner* — Joseph L Perrin
(74) *Attorney, Agent, or Firm* — KED & Associates LLP

(57) ABSTRACT

A washing machine and a control method thereof are provided. The method includes calculating a quantity of a detergent in a washing operation, setting a washing pattern based on the calculated quantity of the detergent, and performing a rinsing operation according to the set washing pattern, thereby improving rinsing capacity of the washing machine.

6 Claims, 11 Drawing Sheets

U.S. PATENT DOCUMENTS

| | | | | |
|---|---|---|---|---|
| 2001/0049846 | A1 | 12/2001 | Guzzi et al. | |
| 2002/0142935 | A1 | 10/2002 | Oubrahim et al. | |
| 2003/0106164 | A1 | 6/2003 | Metzger-Groom et al. | |
| 2005/0081572 | A1* | 4/2005 | Park et al. | 68/12.02 |

FOREIGN PATENT DOCUMENTS

| | | | |
|---|---|---|---|
| DE | 82 34 663 | U1 | 6/1983 |
| DE | 195 41 719 | A1 | 5/1997 |
| EP | 0 051 491 | A1 | 5/1982 |
| EP | 0 331 149 | A2 | 9/1989 |
| EP | 0 619 395 | A1 | 10/1994 |
| EP | 0 633 342 | A1 | 1/1995 |
| GB | 1062774 | | 5/1967 |
| GB | 2 051 413 | A | 1/1981 |
| GB | 2 266 898 | A | 11/1993 |
| JP | 3-106393 | | 5/1991 |
| JP | 6-79086 | | 3/1994 |
| JP | 06-233892 | A | 8/1994 |
| JP | 07-059978 | | 3/1995 |
| JP | 2000-014982 | | 1/2000 |
| JP | 2001-017775 | | 1/2001 |
| JP | 2002-166092 | | 6/2002 |
| KR | 10-1995-0007066 | | 6/1995 |
| KR | 10-0191526 | B1 | 1/1999 |
| KR | 10-2000-0032576 | A | 6/2000 |
| KR | 10-2001-0054769 | A | 7/2001 |
| WO | WO 95/12704 | | 5/1995 |

OTHER PUBLICATIONS

Chinese Office Action dated Mar. 6, 2009.

International Search Report.

European Search Report dated Jan. 21, 2009.

European Search Report dated Mar. 9, 2010 for Application No. 04 735 412.1.

International Search Report, mailed Aug. 19, 2004.

U.S. Office Action U.S. Appl. No. 10/558,188 dated Jan. 22, 2010.

* cited by examiner

WASHING MACHINE AND THE CONTROL METHOD OF THE SAME

TECHNICAL FIELD

The present invention relates to a washing machine and a control method thereof, and more particularly to a washing machine, in which the quantity of a detergent is calculated in a washing operation and a rinsing operation is performed based on a washing pattern set based on the calculated quantity of the detergent, and a control method of the washing machine.

BACKGROUND ART

Generally, a washing machine is an apparatus providing a mechanical action using electricity, thereby removing dirt from clothes. When the clothes are put into water containing a detergent dissolved therein, dirt is removed from the clothes by a chemical action of the detergent. However, since it takes a long time to remove the dirt from the clothes by the chemical action of the detergent alone, the dirt can be easily removed from the clothes by forcibly generating a rotary current or applying a mechanical action such as friction or vibration to the clothes.

The washing machine comprises an outer tub, an inner tub rotatably placed in the outer tub for containing clothes, a wash vane rotatably installed in the inner tub for generating a washing current, and a motor and a clutch installed below the lower part of the outer tub for rotating the inner tub or the wash vane.

The above washing machine has different washing or rinsing capacities based on the quantity of the clothes, the quantity of the detergent, and the hardness of wash water. In a conventional control method of the washing machine, the quantity of the clothes placed into the inner tub is sensed, a washing pattern including washing time, rinsing frequency, rinsing time, dehydrating time, etc. is set based on the sensed quantity of the clothes, and the washing machine is operated according to the set washing pattern.

However, the conventional control method of the washing machine considers only the quantity of the clothes while disregarding the hardness of the water supplied to the washing machine, thus causing a limit in improving washing or rinsing capacity of the washing machine.

DISCLOSURE OF THE INVENTION

Therefore, the present invention has been made in view of the above problems, and it is an object of the present invention to provide a washing machine and a control method thereof, in which a rinsing operation is performed in consideration of the quantity of a detergent calculated in a washing operation, thereby improving a rinsing capacity.

In accordance with one aspect of the present invention, the above and other objects can be accomplished by the provision of a control method of a washing machine comprising the steps of: (a) calculating the quantity of a detergent in a washing operation; (b) setting a washing pattern based on the calculated quantity of the detergent; and (c) performing a rinsing operation according to the set washing pattern.

In accordance with a further aspect of the present invention, there is provided a control method of a washing machine comprising the steps of: (I) setting a washing pattern based on the quantity of clothes; (II) performing a washing operation according to the washing pattern set in step (I), calculating the quantity of a detergent, and resetting the washing pattern based on the calculated quantity of the detergent; and (III) performing a rinsing operation according to the reset washing pattern.

Preferably, step (II) may include the sub-steps of: (i) supplying water and dissolving a detergent in the water according to the washing pattern set in step (I); (ii) calculating the quantity of the detergent after sub-step (i), and resetting the washing pattern based on the calculated quantity of the detergent; and (iii) performing the washing operation according to the washing pattern reset in sub-step (ii), recalculating the quantity of the detergent, and resetting the washing pattern based on the recalculated quantity of the detergent.

Preferably, the washing pattern may include at least one of washing intensity, supplied water level, washing time, rinsing frequency, rinsing time, and dehydrating time.

Further, preferably, step (II) may include the sub-steps of: (i) selecting one table from a plurality of tables containing quantities of the detergent based on the hardness of the water calculated and stored in the previous operation of the washing machine; (ii) measuring the conductivity and temperature of the water containing the detergent dissolved therein; and (iii) calculating the quantity of the detergent by inputting the conductivity and temperature of the water containing the detergent dissolved therein to the selected table.

Moreover, preferably, in step (II), the measurement of the quantity of the detergent may be displayed to the outside while the conductivity and temperature of the water containing the detergent dissolved therein are measured to calculate the quantity of the detergent.

Preferably, in step (III), the conductivity and temperature of the water may be measured during a rinsing operation, and the hardness of the water may be calculated based on the measured conductivity and temperature of the water and stored for the next operation of the washing machine.

Further, preferably, step (II) may include the sub-steps of: (i) supplying a portion of water and dissolving a detergent in the supplied portion of the water according to the washing pattern set in step (I); (ii) calculating the quantity of the detergent after sub-step (i), and resetting the washing pattern based on the calculated quantity of the detergent; and (iii) supplying the residual portion of the water and performing the washing operation according to the washing pattern reset in sub-step (ii), recalculating the quantity of the detergent, and resetting the washing pattern based on the recalculated quantity of the detergent.

Moreover, preferably, sub-steps (i) to (iii) may be repeated plural times such that the residual portion of the water is supplied through multiple stages.

Preferably, after the washing pattern is set based on the quantity of clothes in step (I), washing, rinsing and dehydrating times may be displayed on a display.

Further, preferably, after the washing pattern is reset in step (II), the residual time according to the reset washing pattern may be displayed on a display.

In accordance with another aspect of the present invention, there is provided a control method of a washing machine, wherein, when a sensor assembly senses a state or characteristics of water, the sensed results are indicated to users through an indicator for informing the users of the sensed results.

Preferably, the sensor assembly may sense the state or characteristics of water plural times, and the sensed results may be indicated to the outside through the indicator only in an initial sensing operation of the sensor assembly out of the above plural sensing operations.

Preferably, in case that the indicator includes one LED, the LED may be turned off only when the sensor assembly performs the initial sensing operation, and be turned on when the sensor assembly does not perform the initial sensing operation.

Further, preferably, in case that the indicator includes a plurality of LEDs, all of the plural LEDs may be turned off only when the sensor assembly performs the initial sensing operation, and at least one of the plural LEDs may be turned on when the sensor assembly does not perform the initial sensing operation.

Moreover, preferably, in case that the indicator includes a dual LED expressing a plurality of colors, the dual LED may be turned off such that the colors expressed by the dual LED are sequentially turned off when the sensor assembly performs the initial sensing operation, and be turned on in a single color when the sensor assembly does not perform the initial sensing operation.

In accordance with another aspect of the present invention, there is provided a control method of a washing machine, comprising the steps of: (I) sensing a state or characteristics of water by a sensor assembly; (II) comparing the sensed results obtained by step (I) to predetermined values; and (III) displaying the obtained results obtained by the comparison of step (II) through an indicator.

Preferably, in case that the indicator includes a dual LED expressing a plurality of colors, the dual LED may be turned on in different colors based on whether or not the sensed state or characteristics of water is proper.

In accordance with another aspect of the present invention, there is provided a washing machine comprising: a sensor assembly for sensing a state or characteristics of water contained in the washing machine; an indicator installed in the washing machine for indicating the operation of the sensor assembly to the outside; and a microcomputer for controlling, when the sensor assembly is sensing the state or characteristics of water, the indicator to indicate the sensing operation of the sensor assembly to the outside.

Preferably, the indicator may include one LED.

Further, preferably, the indicator may include a plurality of LEDs.

Moreover, preferably, the indicator may include a dual LED emitting a plurality of colors.

In accordance with yet another aspect of the present invention, there is provided a washing machine comprising: a sensor assembly for sensing a state or characteristics of water contained in the washing machine; an indicator installed in the washing machine for indicating data, regarding the state or characteristics of water sensed by the sensor assembly, to the outside; and a microcomputer for controlling the indicator based on the sensed results of the sensor assembly.

The control method of the present invention calculates the quantity of a detergent in a washing operation, sets a washing pattern based on the calculated quantity of the detergent, and performs a rinsing operation based on the set washing pattern, thereby improving the rinsing capacity of the washing machine.

The control method of the present invention sets a washing pattern based on the quantity of clothes, supplies water according to the set washing pattern, dissolves a detergent in the water, calculates the quantity of the detergent, resets the washing pattern based on the quantity of the detergent, and performs a washing operation according to the reset washing pattern, thereby calculating the accurate quantity of the detergent dissolved in the water and improving the washing capacity of the washing machine using the optimum washing pattern.

The control method of the present invention calculates the quantity of the detergent plural times, and performs a rinsing operation based on the calculated quantity of the detergent, thereby having the optimum rinsing capacity and minimizing water and energy consumption.

The control method of the present invention measures the conductivity and temperature of the water during the rinsing operation, calculates the hardness of the water based on the measured conductivity and temperature of the water, and considers the calculated hardness for the next operation of the washing machine, thereby obtaining optimum washing and rinsing capacities.

The control method of the present invention, when the washing pattern is set, displays washing, rinsing and dehydrating times, and, when the washing pattern is reset, displays the residual time, thereby allowing a user to easily confirm the change in a washing completion time.

The control method of the present invention, when a sensor assembly is sensing a state or characteristics of the water, displays the sensing operation of the sensor assembly through a display, so that the user easily recognizes the operation of the sensor assembly and, even when a driving unit stops or varies in operational rate during the sensing operation of the sensor assembly, does not determines that the driving unit has failed.

The washing machine of the present invention comprises a sensor assembly for sensing a state or characteristics of water contained in the washing machine, an indicator installed in the washing machine for indicating the operation of the sensor assembly to the outside, and a microcomputer for controlling, when the sensor assembly is sensing the state or characteristics of water, the indicator to indicate the sensing operation of the sensor assembly to the outside, thereby allowing the user to confirm whether or not the sensor assembly performs the sensing operation.

Further, the washing machine of the present invention comprises a sensor assembly for sensing a state or characteristics of water contained in the washing machine, an indicator installed in the washing machine for indicating data, regarding the state or characteristics of water sensed by the sensor assembly, to the outside, and a microcomputer for controlling the indicator based on the sensed results of the sensor assembly, thereby allowing the user to confirm whether or not the sensor assembly performs the sensing operation.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be described in detail with reference to the annexed drawings.

Figure 1:
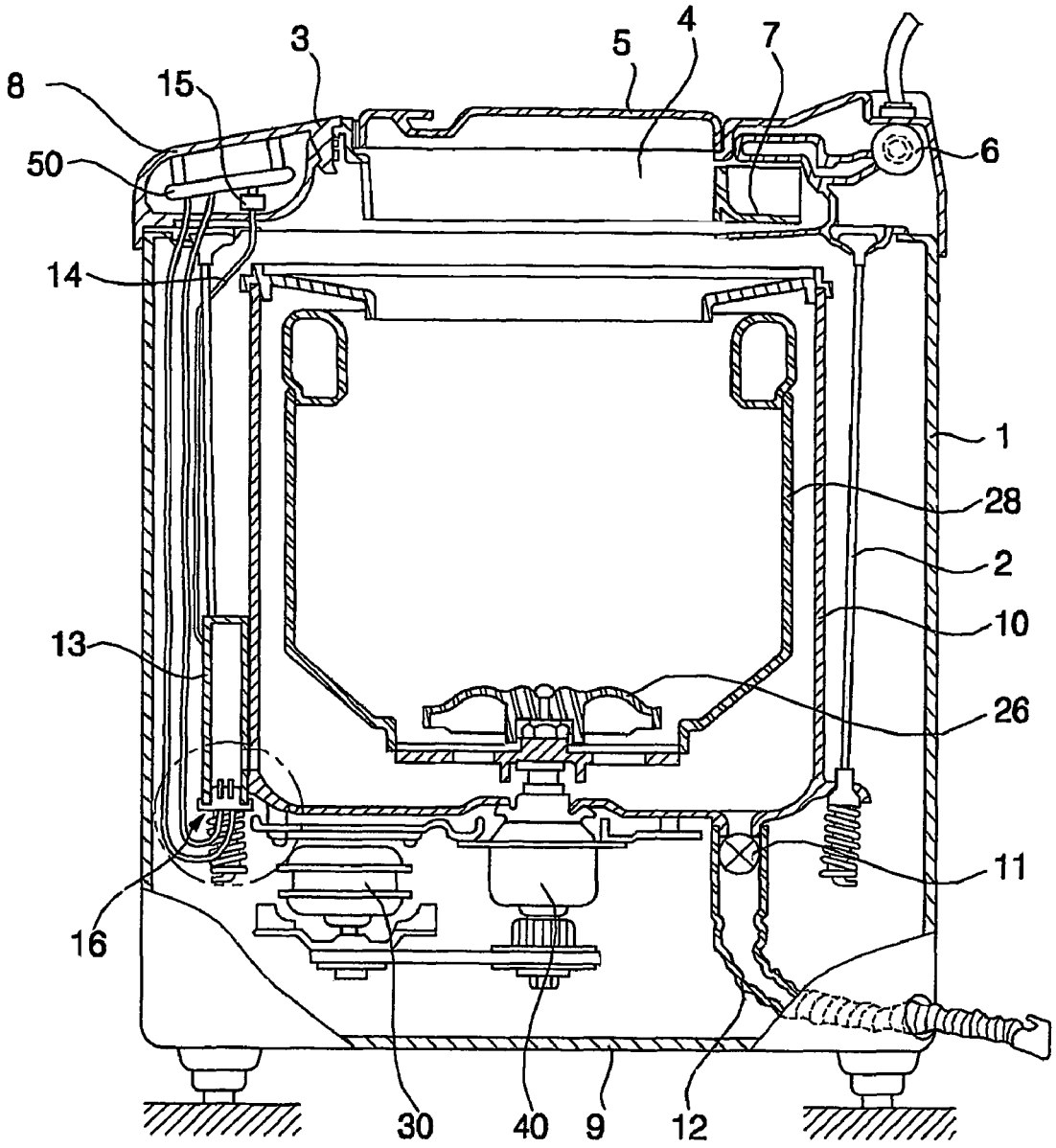
FIG. 1 is a longitudinal-sectional view of a washing machine for performing a control method in accordance with the present invention.
Figure 2:
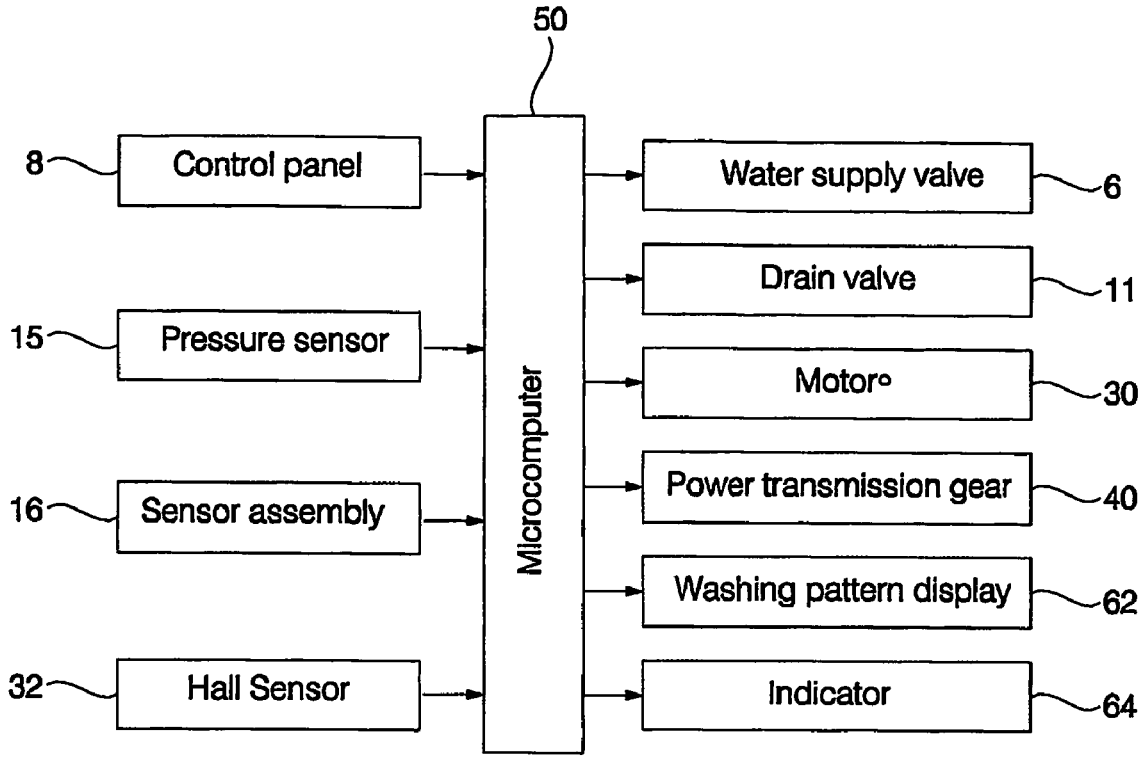
FIG. 2 is a block diagram of the washing machine for performing the control method in accordance with the present invention.

FIG. 1 is a longitudinal-sectional view of a washing machine for performing a control method in accordance with the present invention, and FIG. 2 is a block diagram of the washing machine for performing the control method in accordance with the present invention.

The washing machine shown in FIG. 1 comprises a cabinet 1 defining the external appearance of the washing machine, an outer tub 10 suspended by a supporting member 2 in the cabinet 1 for containing water therein, an inner tub 28 rotatably installed in the outer tub 10 and provided with a wash vane 26 installed on the bottom surface thereof, a motor 30 placed under the outer tub 10 for rotating the wash vane 26 or the inner tub 28, a power transmission gear 40, such as a clutch, for transmitting driving force of the motor 30 to the wash vane 26 or the inner tub 28, and a microcomputer 50 for controlling the operation of the washing machine.

A top cover 3 constituting the upper part of the washing machine is placed on the upper end of the cabinet 1.

An opening 4 for putting and taking clothes into and out of the washing machine therethrough is formed through the central portion of the top cover 3, and a lead 5 for opening and closing the opening 4 is rotatably connected to one side of the top cover 3.

A water supply valve 6, for intermitting water supplied through an external hose, and a detergent box 7, for containing a detergent so that the water having passed through the water supply valve 6 is mixed with the detergent and the obtained mixture is supplied to the inner tub 28 or the outer tub 20, are installed on the rear part of the top cover 3.

The microcomputer 50 is installed in the front part of the top cover 3, and a control panel 8 for allowing a user to manipulate the washing machine therethrough is placed on the front part of the top cover 3.

Legs, which are protruded from the lower surface of the cabinet 1, are mounted on a base 9 supporting the cabinet 1.

A drain valve 11 for intermitting water discharge is installed on the lower part of the outer tub 10, and a drain hose 12 for guiding the water having passed through the drain valve to the outside of the washing machine is connected to the drain valve 11.

An air chamber 13 communicating with the outer tub 10 is installed at one side of the outer tub 10.

An air tube 14 for compressing air, when the water is supplied to the air chamber 13, is connected to the upper part of the air chamber 13, and a pressure sensor 15 for sensing the pressure in the air tube 14 is connected to the air tube 14.

The pressure sensor 15 outputs a signal to the microcomputer 50, and the microcomputer 50 senses a water level based on the signal outputted from the pressure sensor 15.

A sensor assembly 16 for sensing temperature and conductivity of water is installed on the lower end of the air chamber 13.

The sensor assembly 16 senses conductivity and temperature of water, in which the detergent is not dissolved, or conductivity and temperature of water, in which the detergent is dissolved, and thus outputs a corresponding signal to the microcomputer 50. Then, the microcomputer 50 sets a washing pattern, including washing intensity, supplied water level, washing time, rinsing frequency, rinsing time, dehydrating time, etc., based on the signal outputted from the sensor assembly 16.

Here, the washing intensity is adjusted by varying the rotational speed (rpm) of the wash vane 26 or the inner tub 28 or by rotating the wash vane 26 or the inner tub 28.

The motor 30 includes a stator fixed to the lower surface of the outer tub 10, a rotor rotated by the magnetic action with the stator, and a hall sensor 32 for sensing the rotational speed (rpm) or rotational angle of the rotor.

The hall sensor 32 outputs a signal to the microcomputer 50, and the microcomputer 50 senses the quantity of clothes based on the signal outputted from the hall sensor 32.

The microcomputer 50 stores a plurality of tables for determining the quantity of the detergent corresponding to the hardness of the water. Thus, the microcomputer 50 selects one table out of the stored tables based on the hardness of the water, and then determines the quantity of the detergent from the conductivity and temperature of the water, in which the detergent is dissolved, using the selected table.

Figure 3:
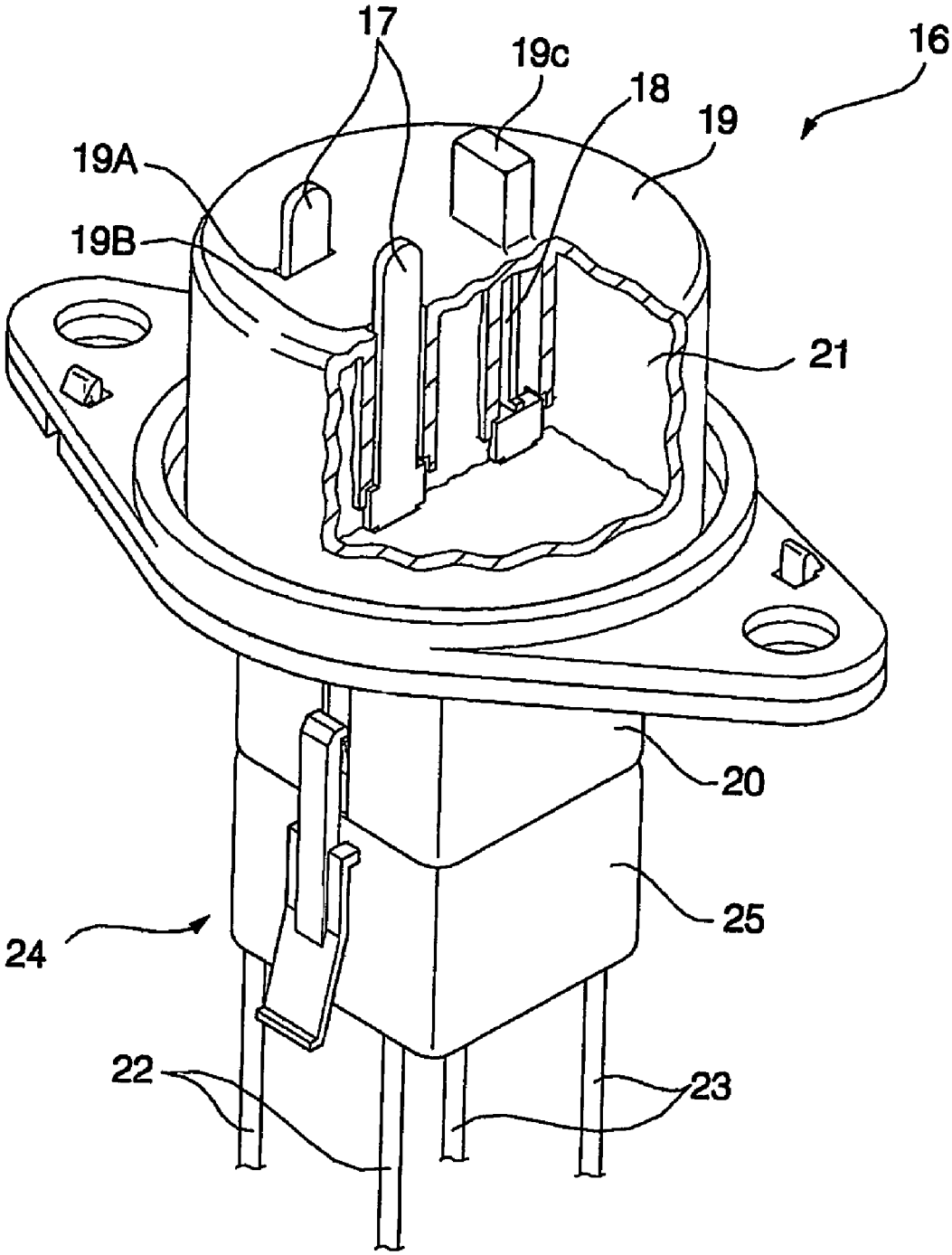
FIG. 3 is a partially-exploded perspective view of a sensor assembly of the washing machine of FIG. 1.
Figure 4:
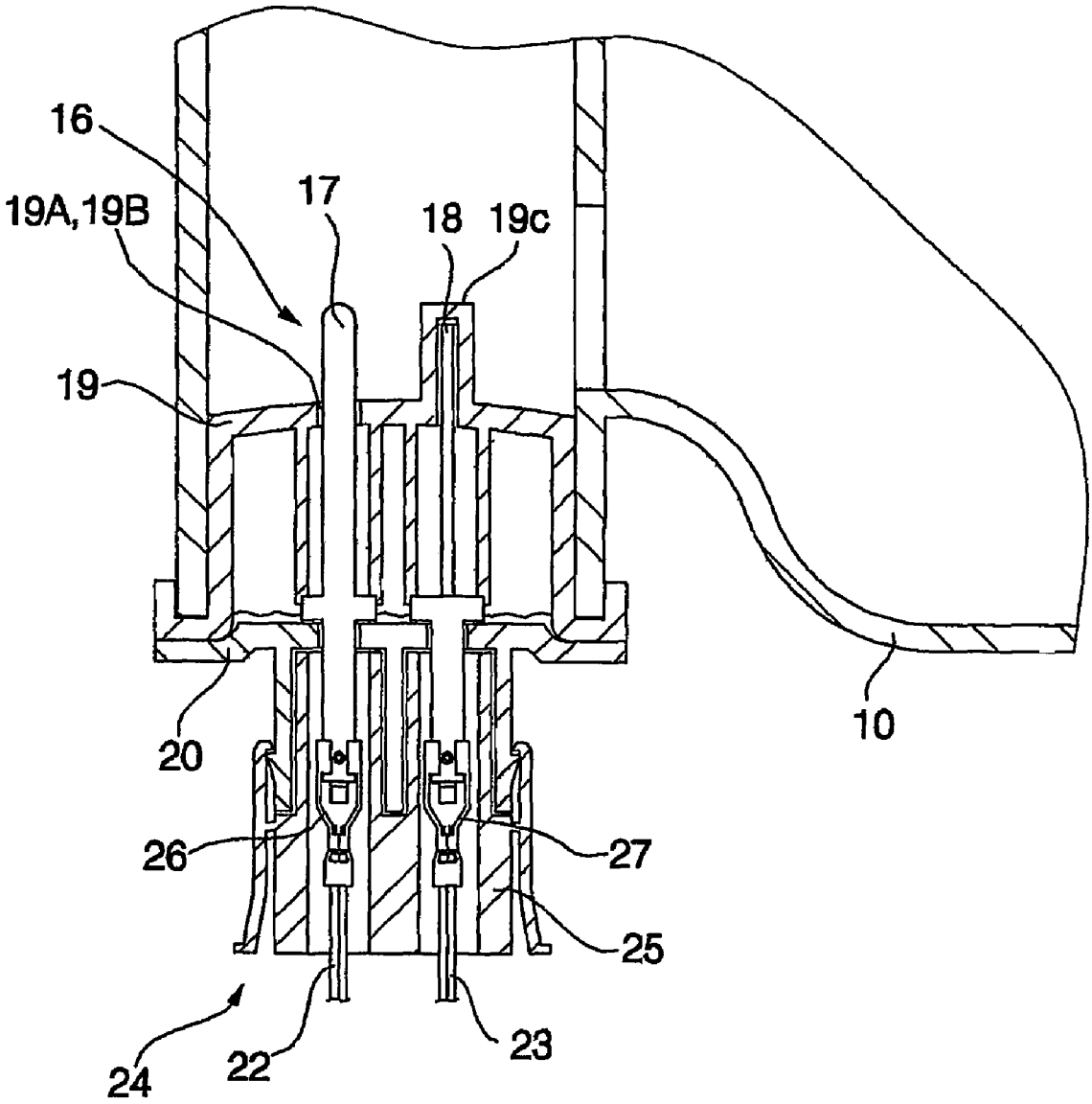
FIG. 4 is an enlarged cross-sectional view of the sensor assembly of the washing machine of FIG. 1.

FIG. 3 is a partially-exploded perspective view of the sensor assembly 16 shown in FIG. 1, and FIG. 4 is an enlarged cross-sectional view of the sensor assembly 16 shown in FIG. 1.

As shown in FIGS. 3 and 4, the sensor assembly 16 includes a conductivity sensor 17 having a pair of conductivity electrodes separated from each other, a temperature sensor 18 having a temperature electrode for sensing a temperature, a housing 19 inserted into the air chamber 13, provided with an opened lower surface, and having a pair of through holes 19A and 19B passing the conductivity electrodes formed on the upper surface thereof and a protrusion 19C surrounding the temperature electrode, a cover 20 passing lower portions of the conductivity electrodes and the temperature electrode and attached to the lower surface of the housing 19, and a filling material 21 filling a space formed between the housing 19 and the cover 20.

A connector 24 provided with a plurality of electric wires 22 and 23 is attached to and detached from the cover 20 so that the sensor assembly 16 and the microcomputer communicate signals with each other.

The connector 24 includes a receptacle housing 25 attachable to and detachable from the cover 20, and a plurality of receptacles 26 and 27 provided with ends connected to the electric wires 22 and 23 and the other ends attached to and detached from the conductivity electrodes and the temperature electrode.

Figure 5:
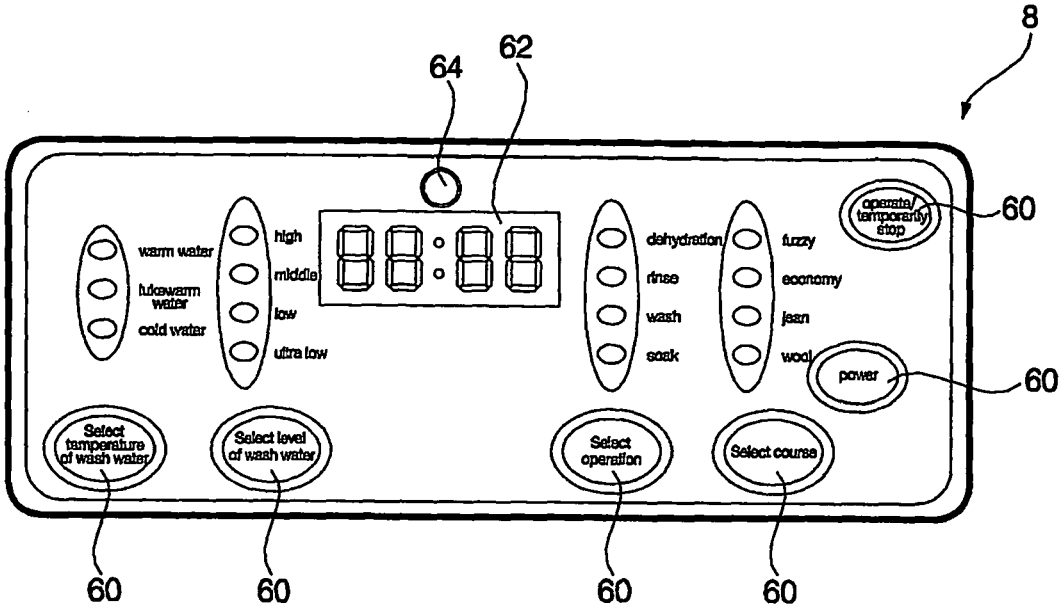
FIG. 5 is a schematic view of one example of a control panel of the washing machine of FIG. 1.

FIG. 5 is a schematic view of one example of a control panel of the washing machine of FIG. 1.

As shown in FIG. 5, the control panel 8 includes at least one operating button 60 for allowing a user to manipulate the washing machine therethrough, a washing pattern display 62, such as an LCD, an LED, or an 88 segment, for displaying the washing pattern of the washing machine to the outside, and an indicator 64 for indicating the sensing state of the sensor assembly or data regarding the state of water sensed by the sensor assembly to the outside.

The indicator 64 may be a dual LED for expressing a plurality of colors or an LED for expressing one color.

Figure 6:
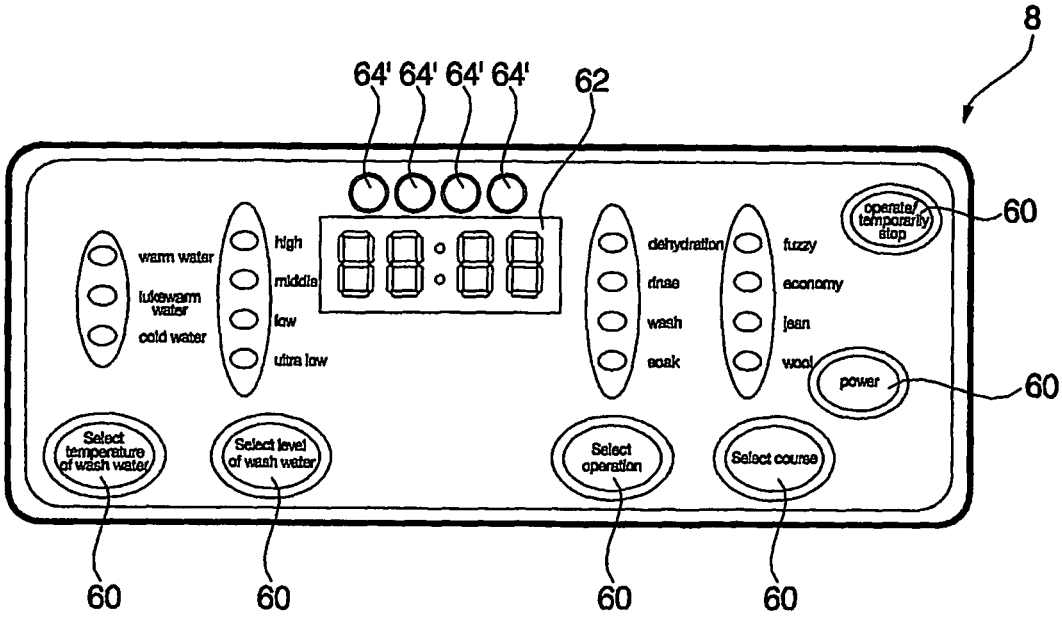
FIG. 6 is a schematic view of another example of the control panel of the washing machine of FIG. 1.

FIG. 6 is a schematic view of another example of the control panel of the washing machine of FIG. 1.

As shown in FIG. 6, the control panel 8 includes an indicator 64' having a plurality of LEDs for indicating the sensing state of the sensor assembly or data regarding the state of water sensed by the sensor assembly to the outside.

Each LED may be a dual LED for expressing a plurality of colors or an LED for expressing one color.

Figure 7A:
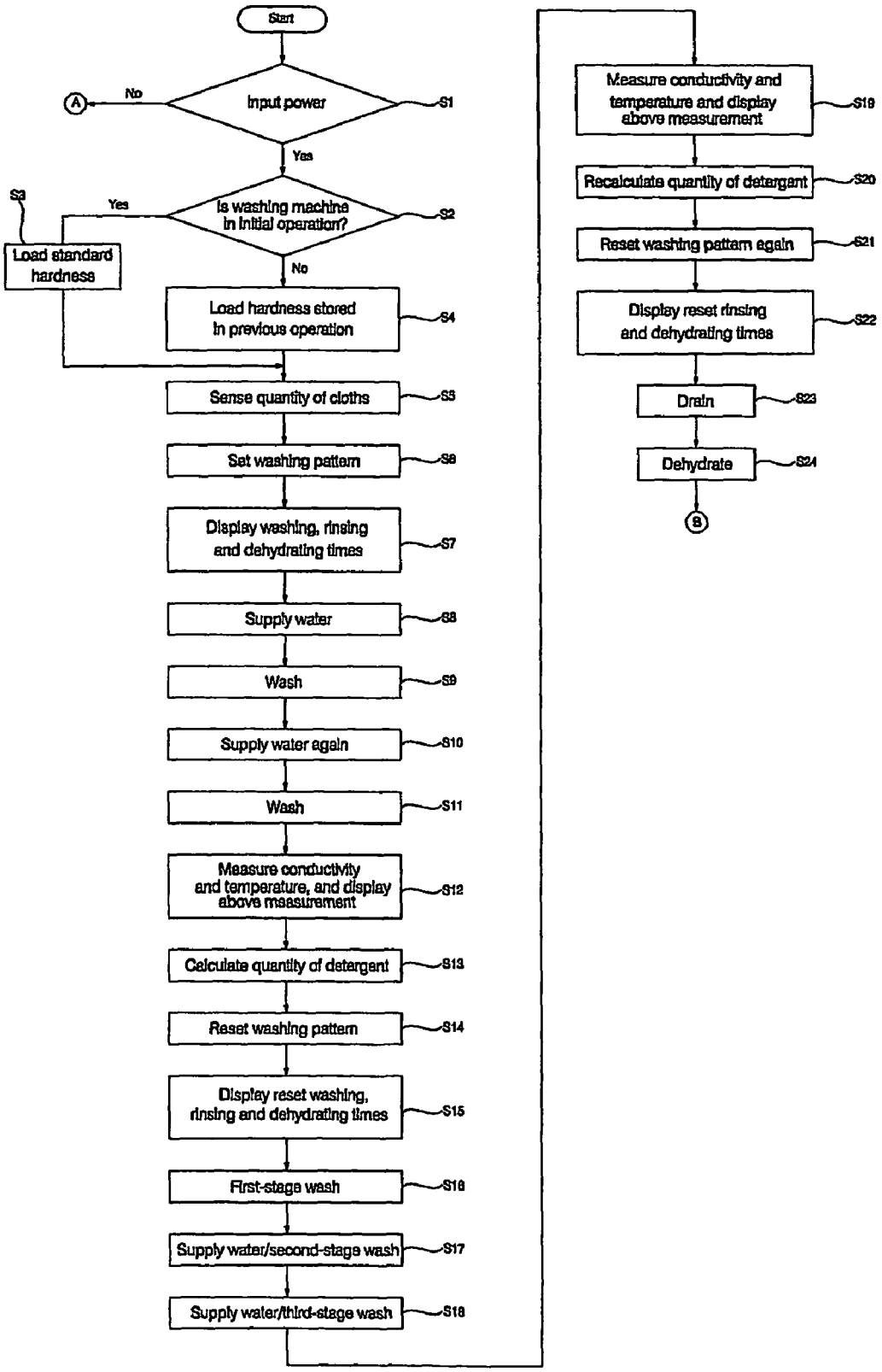
FIGS. 7*a* and 7*b* are flow charts illustrating a control method of a washing machine in accordance with a first embodiment of the present invention.
Figure 7B:
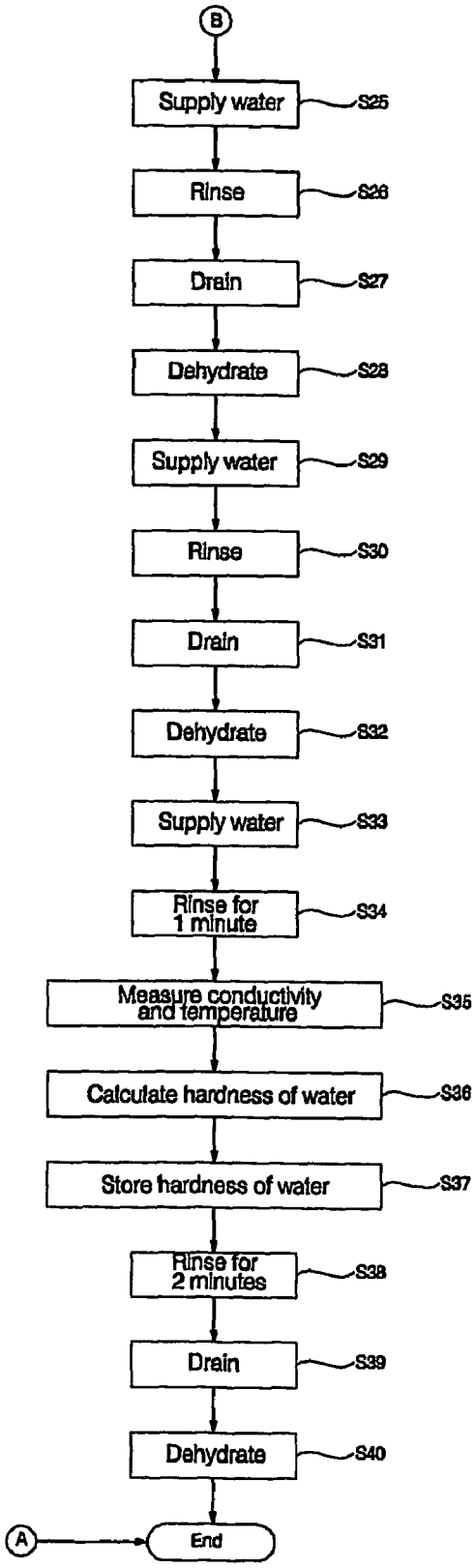

FIGS. 7*a* and 7*b* are flow charts illustrating a control method of a washing machine in accordance with a first embodiment of the present invention.

As shown in FIG. 7*a*, in the control method of the washing machine in accordance with the first embodiment of the present invention, when power and instructions for operating the washing machine are inputted to the washing machine through the control panel 8, the microcomputer 50 determines whether or not the washing machine is in an initial operation (S1 and S2).

In case that it is determined that the washing machine is in the initial operation, the microcomputer 50 loads a standard hardness, which was inputted to the microcomputer 50 in advance. On the other hand, in case that it is determined that the washing machine is not in the initial operation, the microcomputer 50 loads the hardness of the water stored in the previous operation (S3 and S4).

Thereafter, the microcomputer 50 senses the quantity of clothes placed into the washing machine (S5).

Here, the microcomputer 50 rotates the motor 30 so that a pulsator or the inner tub 28 is agitated in a short period of time or rotated once, and measures time, taken to agitate the pulsator or the inner tub 28 or to rotate the pulsator or the inner tub 28 once, or surplus rotating angle from a signal outputted from the hall sensor 32, thereby being capable of sensing the quantity of clothes. Other sensing methods except for the above-described sensing method may be applied to the present invention.

The microcomputer 50 sets a washing pattern based on the sensed quantity of clothes (S6).

Here, preferably, the washing pattern includes all factors regarding the operation of the washing machine, such as washing intensity, supplied water level, washing time, rinsing frequency, rinsing time, dehydrating time, etc. Hereinafter, for convenience of description, the washing pattern is limited to washing intensity, supplied water level, washing time, rinsing frequency, rinsing time, and dehydrating time.

After the microcomputer 50 sets the washing pattern, the microcomputer 50 outputs a control signal to the washing pattern display 62 so that all the factors or only the washing, rinsing and dehydrating times of the set washing pattern are displayed by the washing pattern display 62 to the outside (S7).

The microcomputer 50 turns on the water supply valve 6 so that water is supplied to a first water level of the set washing pattern (S8).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the first water level, the microcomputer 50 turns off the water supply valve 6.

The microcomputer 50 operates the motor 30 during a first washing time of the set washing pattern.

A rotary current is generated in the inner tub 28, thereby performing a washing operation (S9).

Thereafter, after the first washing time has elapsed, the microcomputer 50 turns on the water supply valve 6 so that water is supplied to a second water level of the set washing pattern (S10).

When the water supply valve 6 is turned on, new water is supplied to the inner tub 28 or the outer tub 10 so that the inner tub 28 or the outer tub 10 contains a larger quantity of water. When the water is supplied to the second water level, the microcomputer 50 turns off the water supply valve 6.

Thereafter, the microcomputer 50 operates the motor 30 during a second washing time of the set washing pattern.

Here, the microcomputer 50 rotates the motor 30 in regular and opposite directions so that the clothes contained in the inner tub 28 are agitated to improve solubility of the detergent in the water (S11).

After the second washing time has elapsed, the microcomputer 50 stops the operation of the motor 30.

Then, the microcomputer 50 selects one table out of a plurality of tables storing the quantity of the detergent corresponding to the loaded hardness of the water, outputs a signal to the conductivity sensor 17 and the temperature sensor 18 so that the conductivity sensor 17 and the temperature sensor 18 measure the conductivity and the temperature of the water containing the detergent, and during the measurement, switches on or off the indicator 64 (S12).

The microcomputer 50 calculates the quantity of the detergent using the selected table based on the measured conductivity and temperature of the water containing the detergent (S13).

Then, the microcomputer 50 resets the washing pattern based on the calculated quantity of the detergent for the next operation (S14).

Here, the microcomputer 50 may reset all or several factors of the washing pattern, which were initially set.

The microcomputer 50 outputs a control signal to the washing pattern display 62 so that all the factors or only the residual washing, rinsing and dehydrating times of the reset washing pattern are displayed by the washing pattern display 62 to the outside (S15).

The microcomputer 50 operates the motor 30 during a third washing time of the reset washing pattern (S16).

That is, the wash vane 26 or the inner tub 28 is rotated under the condition that the detergent is fully dissolved in the water so that the solubility of the detergent is high, thereby performing the washing operation.

In case that additional water supply of the reset washing pattern has been set, the microcomputer 50 supplies additional water to a water level higher than the first and second water levels and continuously rotates the motor 30.

Here, the microcomputer 50 may supply additional water once, or gradually supply additional water plural times. Hereinafter, for convenience of description, the frequency of the additional water supply is limited to two.

After the third washing time has elapsed, the microcomputer 50 supplies additional water to a third water level, and continuously rotates the motor 30 for a fourth washing time (S17).

When the water supply valve 6 is turned on, new water is supplied to the inner tub 28 or the outer tub 10 so that the inner tub 28 or the outer tub 10 contains a larger quantity of water. When the water is supplied to the third water level, the microcomputer 50 turns off the water supply valve 6.

After the fourth washing time has elapsed, the microcomputer 50 supplies additional water to a fourth water level higher than the third water level, and continuously rotates the motor 30 for a fifth washing time (S18).

When the water supply valve 6 is turned on, new water is supplied to the inner tub 28 or the outer tub 10 so that the inner tub 28 or the outer tub 10 contains a larger quantity of water. When the water is supplied to the fourth water level, the microcomputer 50 turns off the water supply valve 6.

Here, in the above-described additional water supply, the microcomputer 50 may again measure the conductivity and temperature of the water containing the detergent dissolved therein before the washing operation in the third water level is completed, again calculate the quantity of the detergent based on the measured conductivity and temperature of the water, and reset the washing pattern, such as the fourth water level and/or the fifth washing time, based on the calculated quantity of the detergent.

Then, the microcomputer 50 again calculates the quantity of the detergent, before the above washing operation is completed, in order to reset the washing pattern for rinsing and dehydrating operations or only a rinsing operation.

That is, before the fifth washing time has elapsed, the microcomputer 50 selects one table out of a plurality of tables storing the quantity of the detergent corresponding to the loaded hardness of the water, outputs a signal to the conductivity sensor 17 and the temperature sensor 18 so that the conductivity sensor 17 and the temperature sensor 18 measure the conductivity and the temperature of the water containing the detergent dissolved therein, and during the measurement, switches on or off the indicator 64 (S19).

The microcomputer 50 again calculates the quantity of the detergent using the selected table based on the measured conductivity and temperature of the water containing the detergent (S20).

Then, the microcomputer 50 resets the washing pattern based on the calculated quantity of the detergent (S21).

Here, the microcomputer 50 may reset all or several factors of the washing pattern, which were initially set.

The microcomputer 50 outputs a control signal to the washing pattern display 62 so that all the factors or only the residual washing, rinsing and dehydrating times of the reset washing pattern are displayed by the washing pattern display 62 to the outside (S22).

After the washing pattern has been reset and the fifth washing time has elapsed, the microcomputer 50 turns on the drain valve 11 so that water contaminated during the washing operation is discharged to the outside of the washing machine, and, after the discharge of the contaminated water is completed, turns off the drain valve 11 (S23).

Then, the microcomputer 50 operates the motor 30 and the power transmission gear 40 in a dehydration mode, thereby dehydrating the clothes in the washing machine (S24).

As shown in FIG. 7*b*, the microcomputer 50 repeats water supply, rinse, drain and dehydration times corresponding to a rinsing frequency of the reset washing pattern.

Here, for convenience of description, the rinsing frequency is reset to three times.

The microcomputer 50 turns on the water supply valve 6 so that water is supplied to a fifth water level of the reset washing pattern (S25).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the fifth water level, the microcomputer 50 turns off the water supply valve 6.

The microcomputer 50 operates the motor 30 during a first rinsing time of the reset washing pattern.

A rotary current is generated in the inner tub 28, thereby performing a rinsing operation (S26).

Thereafter, after the first rinsing time has elapsed, the microcomputer 50 turns on the drain valve 11 so that water contaminated during the rising operation is discharged to the outside of the washing machine, and, after the discharge of the contaminated water is completed, turns off the drain valve 11 (S27).

Then, the microcomputer 50 operates the motor 30 and the power transmission gear 40 in the dehydration mode, thereby dehydrating the clothes in the washing machine (S28).

Thereafter, the microcomputer 50 turns on the water supply valve 6 so that water is supplied to a sixth water level of the reset washing pattern (S29).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the sixth water level, the microcomputer 50 turns off the water supply valve 6.

The microcomputer 50 operates the motor 30 during a second rinsing time of the reset washing pattern.

A rotary current is generated in the inner tub 28, thereby performing the rinsing operation (S30).

Thereafter, after the second rinsing time has elapsed, the microcomputer 50 turns on the drain valve 11 so that water contaminated during the rising operation is discharged to the outside of the washing machine, and, after the discharge of the contaminated water is completed, turns off the drain valve 11 (S31).

Then, the microcomputer 50 operates the motor 30 and the power transmission gear 40 in the dehydration mode, thereby dehydrating the clothes in the washing machine (S32).

Thereafter, the microcomputer 50 turns on the water supply valve 6 so that water is supplied to a seventh water level of the reset washing pattern (S33).

When the water supply valve 6 is turned on, the water passes through the detergent box 7, the detergent contained in the detergent box 7 is dissolved in the water, and the obtained mixture is supplied to the inner tub 28 or the outer tub 10. When the mixture of the water and the detergent is supplied to the seventh water level, the microcomputer 50 turns off the water supply valve 6.

The microcomputer 50 operates the motor 30 during a third rinsing time of the reset washing pattern.

The microcomputer 50 is rotatably agitated for a designated time (for example, 1 minute) of the third rinsing time (for example, 3 minutes) so that accuracy in calculating the hardness of the water, which will be described later, is improved.

After the designated time (for example, 1 minute) of the third rinsing time (for example, 3 minutes) has elapsed, the microcomputer 50 outputs a signal to the conductivity sensor 17 and the temperature sensor 18 so that the conductivity sensor 17 and the temperature sensor 18 measure the conductivity and the temperature of the water (S34 and S35).

The microcomputer 50 calculates the hardness of the water using a designated equation or a table for determining the hardness of the water based on the measured conductivity and temperature of the water (S36).

The microcomputer 50 stores the calculated hardness of the water in an EEPROM (S37).

Then, the microcomputer 50 continuously operates the motor 30 for the residual time (for example, 2 minutes) of the third rinsing time (for example, 3 minutes), and a rotary current is generated in the inner tub 28, thereby performing the rinsing operation (S38).

After the third rinsing time has elapsed, the microcomputer 50 turns on the drain valve 11 so that water contaminated during the rising operation is discharged to the outside of the washing machine, and, after the discharge of the contaminated water is completed, turns off the drain valve 11 (S39).

Then, the microcomputer 50 operates the motor 30 and the power transmission gear 40 in the dehydration mode, thereby dehydrating the clothes in the washing machine (S40).

Figure 8:
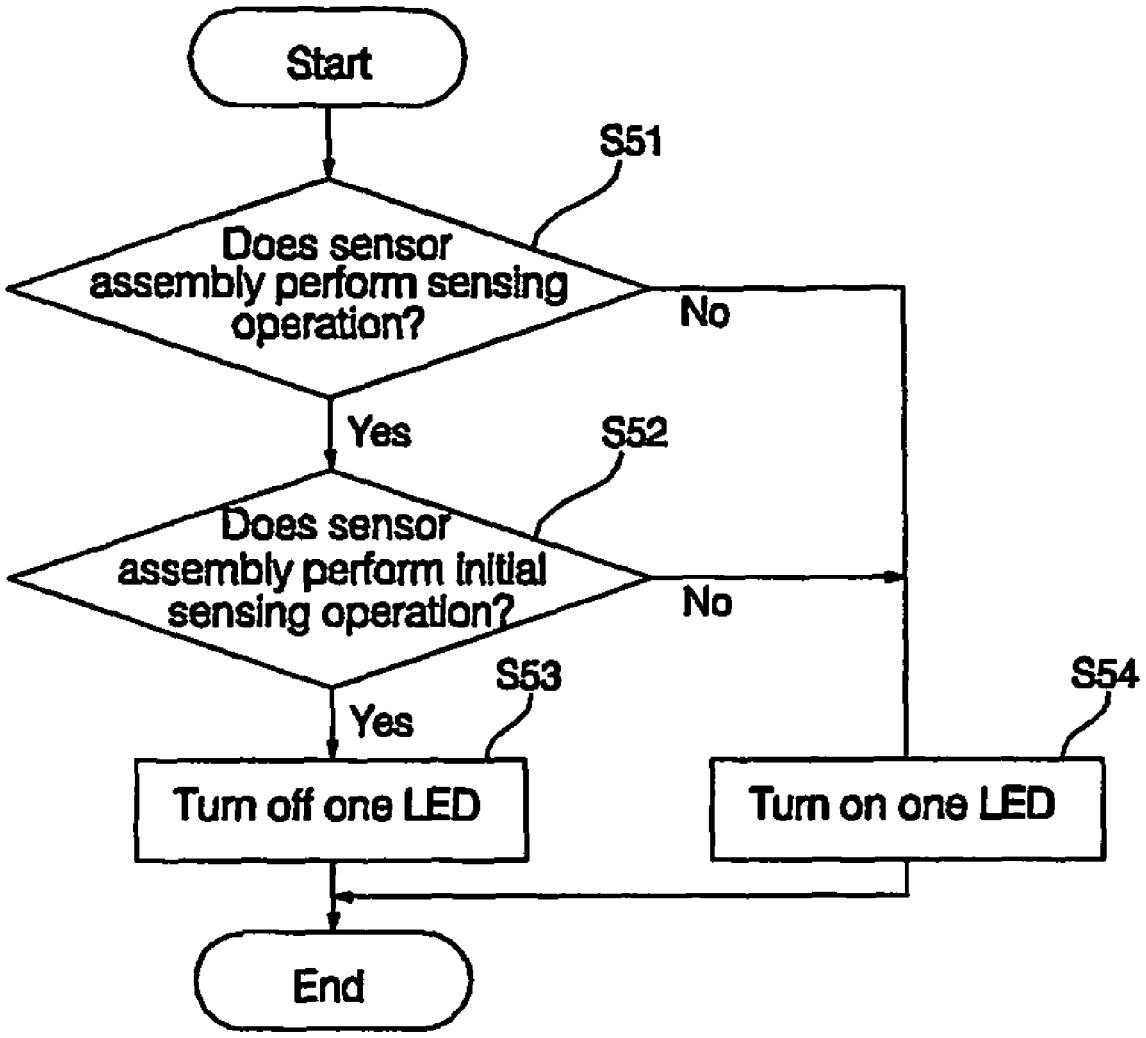
FIG. 8 is a flow chart illustrating a control method of a washing machine in accordance with a second embodiment of the present invention.

FIG. 8 is a flow chart illustrating a control method of a washing machine in accordance with a second embodiment of the present invention.

For reference, parts of the constitution and operation of the second embodiment are substantially the same as those of the first embodiment and a detailed description thereof will thus be omitted because it is considered to be unnecessary.

In the control method of the washing machine in accordance with the second embodiment as shown in FIG. 8, when the sensor assembly 16 senses a state or characteristics of water, such as conductivity and temperature of water, plural times and the display includes a single LED, the sensed results obtained only in a first sensing operation are displayed to the outside through the indicator 64.

In case that the sensor assembly 16 performs the first sensing operation, the LED is turned off during the first sensing operation (S51, S52 and S53).

Further, in case that the sensor assembly 16 performs a second or third sensing operation, the LED is turned on (S52 and S54).

On the other hand, in case that the sensor assembly 16 does not perform any sensing operation, the LED is turned on (S51 and S54).

That is, in case that a driving unit, such as a motor, stops or varies in operational rate while the sensor assembly 16 senses the state or characteristics of the water, a user determines that the sensor assembly 16 has failed. As described above, when the LED is turned off only in the first sensing operation, the user easily determines that the sensor assembly 16 is being operated.

Figure 9:
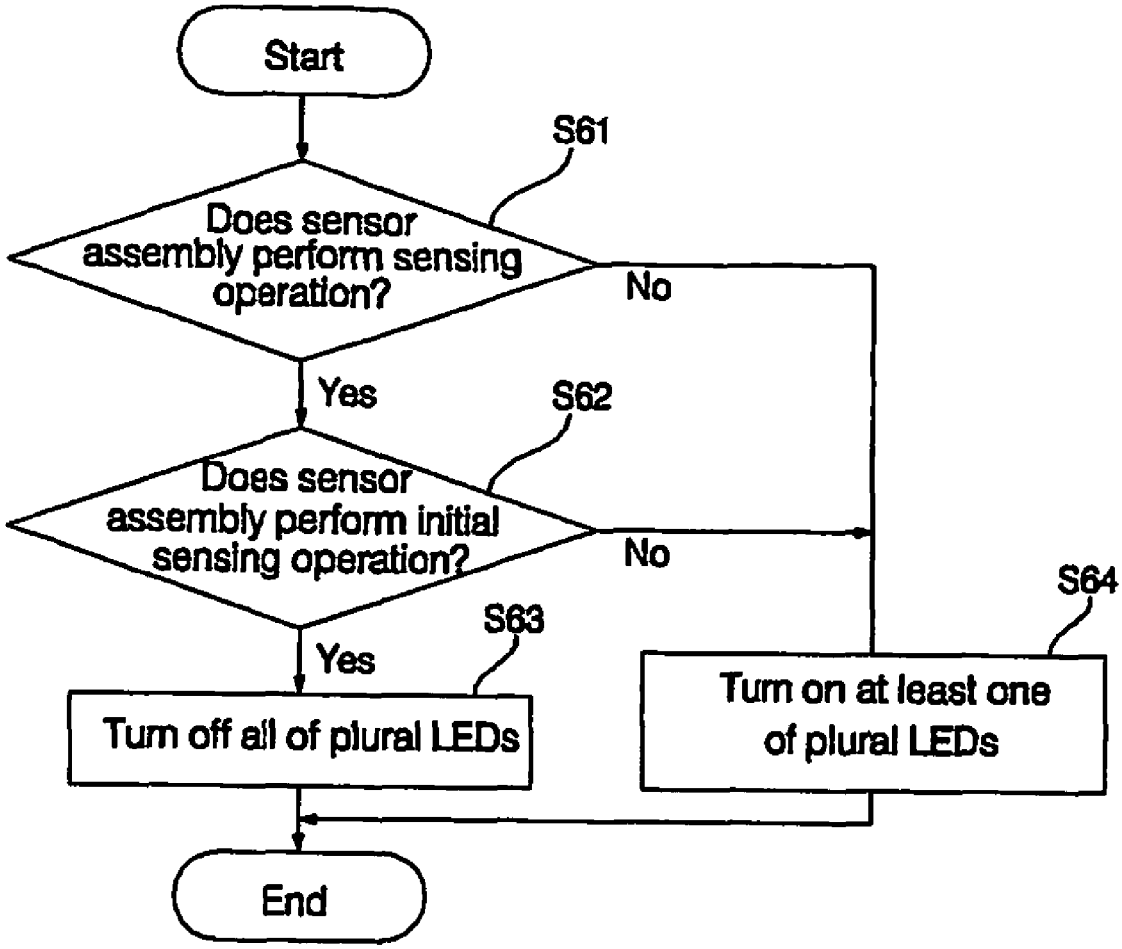
FIG. 9 is a flow chart illustrating a control method of a washing machine in accordance with a third embodiment of the present invention.

FIG. 9 is a flow chart illustrating a control method of a washing machine in accordance with a third embodiment of the present invention.

For reference, parts of the constitution and operation of the third embodiment are substantially the same as those of the first embodiment and a detailed description thereof will thus be omitted because it is considered to be unnecessary.

In the control method of the washing machine in accordance with the third embodiment as shown in FIG. 9, when the indicator includes a plurality of LEDs, in case that the sensor assembly 16 performs the first sensing operation, all of the plural LEDs are turned off in the first sensing operation (S61, S62 and S63).

Further, in case that the sensor assembly 16 performs a second or third sensing operation, at least one of the plural LEDs is turned on (S62 and S64).

On the other hand, in case that the sensor assembly 16 does not perform any sensing operation, at least one of the plural LEDs is turned on (S61 and S64).

Figure 10:
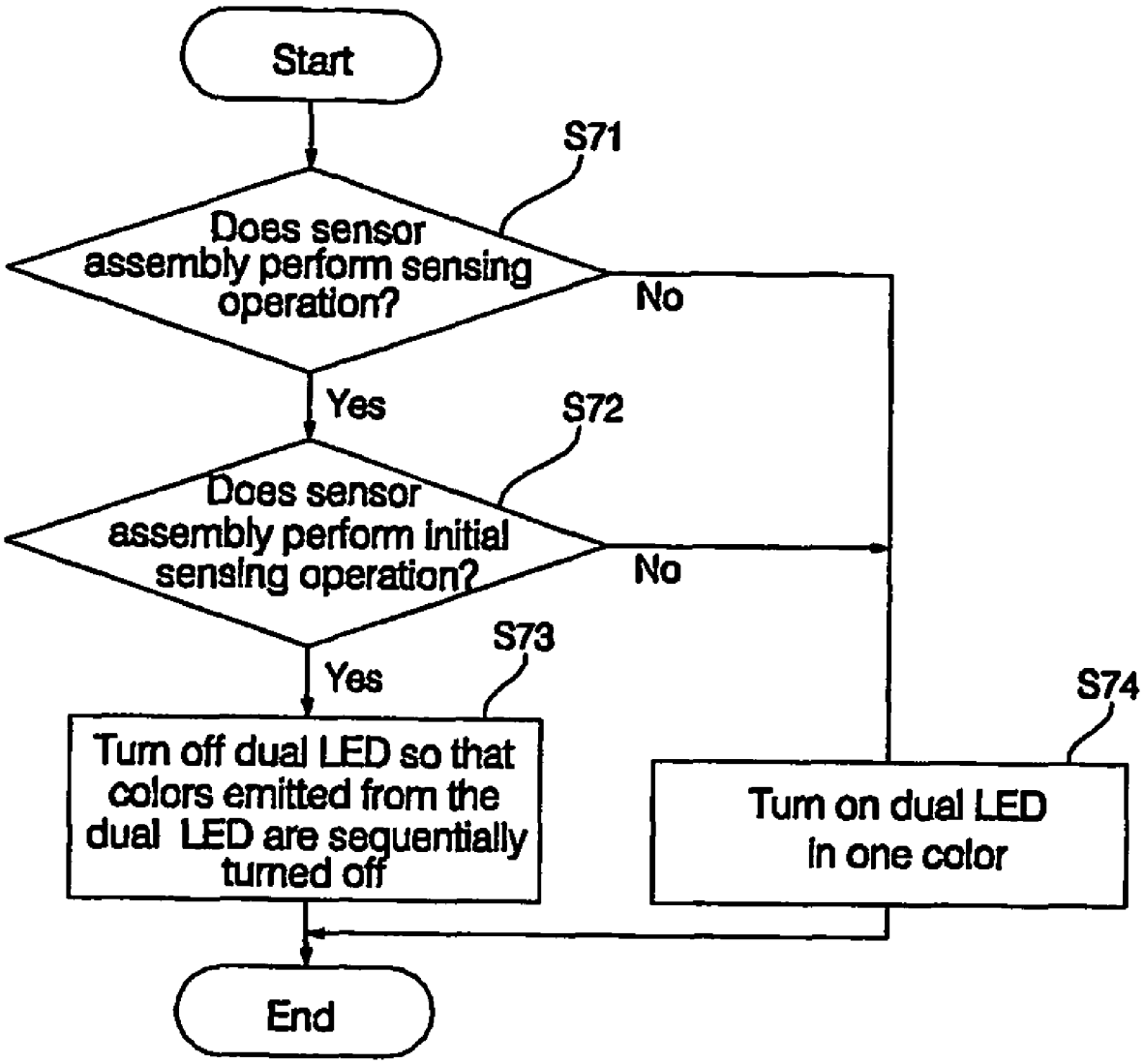
FIG. 10 is a flow chart illustrating a control method of a washing machine in accordance with a fourth embodiment of the present invention.

FIG. 10 is a flow chart illustrating a control method of a washing machine in accordance with a fourth embodiment of the present invention.

For reference, parts of the constitution and operation of the fourth embodiment are substantially the same as those of the first embodiment and a detailed description thereof will thus be omitted because it is considered to be unnecessary.

In the control method of the washing machine in accordance with the fourth embodiment as shown in FIG. 10, when the display includes a dual LED for expressing a plurality of colors, in case that the sensor assembly 16 performs the first sensing operation, the dual LED is turned off during the first sensing operation such that the colors expressed by the dual LED are sequentially turned off (S71, S72 and S73).

Further, in case that the sensor assembly 16 performs a second or third sensing operation, the dual LED is turned on in a single color (S72 and S74).

On the other hand, in case that the sensor assembly 16 does not perform any sensing operation, the dual LED is turned on in a single color (S71 and S74).

Figure 11:
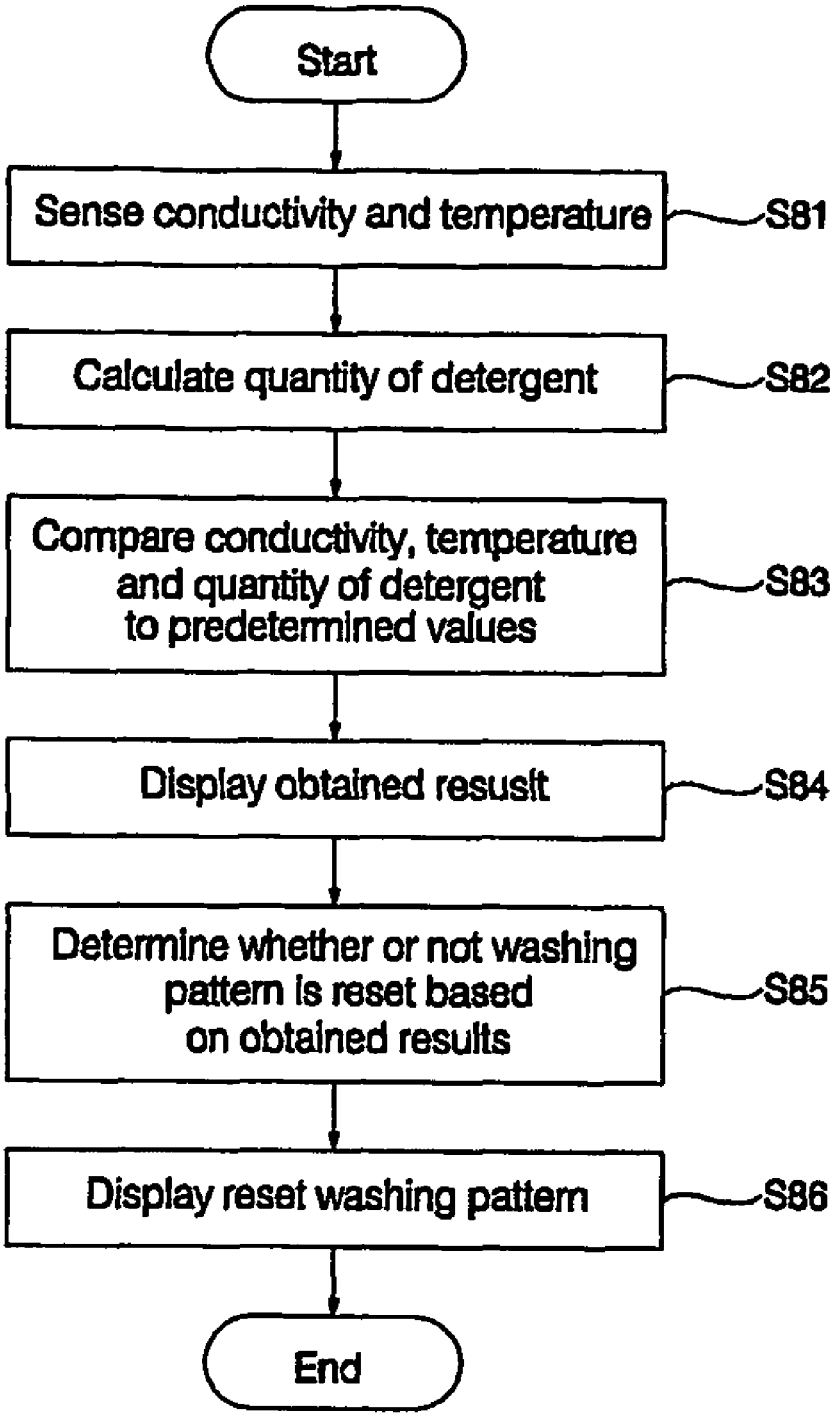
FIG. 11 is a flow chart illustrating a control method of a washing machine in accordance with a fifth embodiment of the present invention.

FIG. 11 is a flow chart illustrating a control method of a washing machine in accordance with a fifth embodiment of the present invention.

For reference, parts of the constitution and operation of the fifth embodiment are substantially the same as those of the first embodiment and a detailed description thereof will thus be omitted because it is considered to be unnecessary.

In the control method of the washing machine in accordance with the fifth embodiment as shown in FIG. 11, when the display includes dual LEDs for expressing a plurality of colors, sensed results and determined results of the display state or characteristics of the water are shown in Table 1 below.

TABLE 1

| | | |
|---|---|---|
| Temperature of Water | High | Color 1 |
| | Low | Color 2 |
| Hardness of Water | High | Color 1 |
| | Low | Color 2 |
| Quantity of Detergent | Excessively large | Color 1 |
| | Small | Color 2 |
| Washing Time | Increase | Color 1 |
| | Decrease | Color 2 |

In Table 1, the temperature of the water, the hardness of the water, and the quantity of the detergent are the obtained results sensed by the sensor assembly 16, and the washing time is determined by a washing pattern reset based on the state or characteristics of the water.

Further, when the dual LED expresses three colors, sensed results and determined results of the display state or characteristics of the water are shown in Table 2.

TABLE 2

| | | |
|---|---|---|
| Temperature of Water | High | Color 1 |
| | Middle | Color 2 |
| | Low | Color 3 |
| Hardness of Water | High | Color 1 |
| | Middle | Color 2 |
| | Low | Color 3 |
| Quantity of Detergent | Excessively large | Color 1 |
| | Normal | Color 2 |
| | Small | Color 3 |
| Washing Time | Increase | Color 1 |
| | No Variation | Color 2 |
| | Decrease | Color 3 |

In Table 2, in the same manner as Table 1, the temperature of the water, the hardness of the water, and the quantity of the detergent are the obtained results sensed by the sensor assembly 16, and the washing time is determined by a washing pattern reset based on the state or characteristics of the water.

As shown in Tables 1 and 2, sensed results and determined results of the display state or characteristics of the water, which are displaced on the dual LED, vary based on the number of the colors expressed by the dual LED, and the number of the colors expressed by the dual LED is increased or decreased according to purpose and necessity of the dual LED.

In the control method of the washing machine in accordance with the fifth embodiment as shown in FIG. 11, the state or characteristics of the water, i.e., the conductivity and temperature of the water, are sensed (S81).

Thereafter, the hardness of the water is calculated using the sensed conductivity and temperature of the water, and the quantity of the detergent is calculated based on the hardness of the water (S82).

Then, the temperature and hardness of the water and the quantity of the detergent, which are the sensed results of the state or characteristics of the water, are compared to predetermined values corresponding thereto (S83).

The results, obtained by comparing the temperature and hardness of the water and the quantity of the detergent to the predetermined values, are respectively displayed on the corresponding dual LEDs (S84).

Further, it is determined whether or not the washing pattern is reset based on the above obtained results (S85).

In case that it is determined that the washing pattern is reset, the washing time of the reset washing pattern is displayed on the residual dual LED (S86).

INDUSTRIAL APPLICABILITY

As apparent from the above description, the present invention provides a control method of a washing machine, which calculates the quantity of a detergent in a washing operation, sets a washing pattern based on the calculated quantity of the detergent, and performs a rinsing operation based on the set washing pattern, thereby improving the rinsing capacity of the washing machine.

The control method of the present invention sets a washing pattern based on the quantity of clothes, supplies water according to the set washing pattern, dissolves a detergent in the water, calculates the quantity of the detergent, resets the washing pattern based on the quantity of the detergent, and performs a washing operation according to the reset washing pattern, thereby calculating the accurate quantity of the detergent dissolved in the water and improving the washing capacity of the washing machine using the optimum washing pattern.

The control method of the present invention calculates the quantity of the detergent plural times, and performs a rinsing operation based on the calculated quantity of the detergent, thereby obtaining optimum rinsing capacity and minimizing water and energy consumption.

The control method of the present invention measures the conductivity and temperature of the water during the rinsing operation, calculates the hardness of the water based on the measured conductivity and temperature of the water, and considers the calculated hardness in the next operation of the washing machine, thereby obtaining optimum washing and rinsing capacities.

The control method of the present invention, when the washing pattern is set, displays washing, rinsing and dehydrating times, and, when the washing pattern is reset, displays the residual time, thereby allowing a user to easily confirm the change in a washing completion time.

The control method of the present invention, when a sensor assembly is sensing a state or characteristics of the water, indicates the sensing operation of the sensor assembly through an indicator, so that the user easily recognizes the operation of the sensor assembly and, even when a driving unit stops or varies in operational rate during the sensing operation of the sensor assembly, does not determines that the driving unit has failed.

Further, the present invention provides a washing machine comprising a sensor assembly for sensing a state or characteristics of water contained in the washing machine, an indicator installed in the washing machine for indicating the operation of the sensor assembly to the outside, and a microcomputer for controlling, when the sensor assembly is sensing the state or characteristics of water, the indicator to indicate the sensing operation of the sensor assembly to the outside, thereby allowing the user to confirm whether or not the sensor assembly performs the sensing operation.

Moreover, the present invention provides a washing machine comprising a sensor assembly for sensing a state or characteristics of water contained in the washing machine, an indicator installed in the washing machine for indicating data, regarding the state or characteristics of water sensed by the sensor assembly, to the outside, and a microcomputer for controlling the indicator based on the sensed results of the sensor assembly, thereby allowing the user to confirm whether or not the sensor assembly performs the sensing operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A control method for a wash cycle, including a washing operation and a rinsing operation of a washing machine, the control method comprising:

sensing a quantity of clothes;

setting a first washing pattern based on the quantity of clothes;

performing a first washing operation, during which a detergent and a portion of water for the washing operation is supplied into a tub, according to the set first washing pattern, calculating a quantity of a detergent which is supplied into the tub, and resetting the washing pattern to a second washing pattern based on the calculated quantity of the detergent;

performing a second washing operation, during which a residual portion of water for the washing operation is supplied into the tub, according to the second washing pattern, recalculating the quantity of the detergent dissolved in water supplied into the tub, and resetting the washing pattern to a third washing pattern based on the recalculated quantity of the detergent;

performing the rinsing operation according to the third washing pattern; and measuring a conductivity and a temperature of the water during the rinsing operation, and calculating and storing a hardness of the water based on the measured conductivity and temperature of the water for a next operation of the washing machine.

2. The control method as set forth in claim 1, wherein the washing patterns include at least one of washing intensity, supplied water level, washing time, rinsing frequency, rinsing time, or dehydrating time.

3. The control method as set forth in claim 1, wherein the calculating the quantity of the detergent includes:

selecting one table from a plurality of tables containing quantities of the detergent based on a hardness of water calculated and stored in a previous operation of the washing machine;

measuring a conductivity and temperature of the water containing the detergent dissolved therein; and calculating the quantity of the detergent by inputting the conductivity and temperature of the water containing the detergent dissolved therein to the selected table.

4. The control method as set forth in claim 1, further comprising repeating the supplying, calculating, and supplying of claim 2 a plurality of times such that the residual portion of the water is supplied through multiple stages.

5. The control method as set forth in claim 1, wherein when the washing pattern is set based on the quantity of clothes, washing, rinsing, and dehydrating times are displayed on a display.

6. The control method as set forth in claim 1, wherein when the washing pattern is reset, a residual time according to the reset washing pattern is displayed on a display.

* * * * *